US007021953B2

(12) United States Patent
Kawamae

(10) Patent No.: US 7,021,953 B2
(45) Date of Patent: Apr. 4, 2006

(54) CARD EDGE CONNECTOR LATCH

(75) Inventor: Takahiro Kawamae, Shanghai (CN)

(73) Assignee: Tyco Electronics AMP K.K., Kanagawa-ken (JP)

( * ) Notice: Subject to any disclaimer, the term of this patent is extended or adjusted under 35 U.S.C. 154(b) by 98 days.

(21) Appl. No.: 10/753,791

(22) Filed: Jan. 8, 2004

(65) Prior Publication Data

US 2004/0152353 A1 Aug. 5, 2004

(30) Foreign Application Priority Data

Jan. 8, 2003 (JP) ..... 2003-002401
Oct. 31, 2003 (JP) ..... 2003-372810

(51) Int. Cl.
*H01R 13/62* (2006.01)

(52) U.S. Cl. ..... 439/326

(58) Field of Classification Search ..... 439/325–328
See application file for complete search history.

(56) References Cited

U.S. PATENT DOCUMENTS 3,404,785 A * 10/1968 Emary ..... 211/183
4,198,024 A * 4/1980 Cavanna ..... 248/544
4,521,065 A * 6/1985 Nestor et al. ..... 439/61
6,419,513 B1 * 7/2002 Choy ..... 439/326
6,796,825 B1 * 9/2004 Wang ..... 439/326
6,923,668 B1 * 8/2005 Tsai ..... 439/326
2004/0152353 A1 * 8/2004 Kawamae ..... 439/328

FOREIGN PATENT DOCUMENTS

JP 08102346 A 4/1996
JP 08273747 A 10/1996

* cited by examiner

*Primary Examiner*—Gary Paumen
*Assistant Examiner*—James R. Harvey
(74) *Attorney, Agent, or Firm*—Barley Snyder LLC

(57) ABSTRACT

A card edge connector latch is provided which makes it possible to install cards or cards side by side at a high density on a motherboard without increasing the overall size of the connector. The card edge connector latch is used together with a card edge connector that is mounted on a motherboard. The latch comprises board fasteners which are fastened to the motherboard, and latches which latch an opposite end portion of the card, a contact end portion of which is received in the card edge connector 1, in a state in which the card is substantially parallel to the motherboard. The latch is carried on and fastened to the motherboard opposite the card edge connector without being assembled with the card edge connector. The latches extend toward and engage with the opposite end portion of the card.

16 Claims, 11 Drawing Sheets

CARD EDGE CONNECTOR LATCH

BACKGROUND OF THE INVENTION

1. Field of the Invention

The present invention relates to a card edge connector latch which is used together with a card edge connector for connecting a card (daughter board) such as a memory module to a motherboard.

2. Description of the Related Art

It is often desirable to connect cards such as memory modules to a motherboard. Typically, card edge connectors are used to make such connections.

For example, a known card edge connector for connecting cards such as memory modules to a motherboard comprises a box-shaped insulator which receives a contact end portion of a card and which is provided with a plurality of contacts and a frame, which is disposed on the front side of the upper surface of this insulator. The frame is formed by stamping and forming a metal plate, and comprises a connecting portion, which extends along the upper surface of the insulator in the lengthwise direction. A pair of side frames extend from both ends of the connecting portion in a direction perpendicular to the lengthwise direction. A slit, which opens at the tip end, is formed in the center (with respect to the vertical direction) of the tip end of each side frame. Latches for latching the card to the motherboard in a substantially parallel state are formed so that these latches are bent inward on latching arms located on the upper sides of the slits. Board fasteners for fastening the card edge connector to the motherboard are formed so that these board fasteners are bent outward on arms located on the lower sides of the slits.

In order to connect the card to the foregoing exemplary card edge connector, the contact end portion of the card is first inserted into the insulator at an inclination from above the insulator. Then, the card is rotated so that the front end of the card (i.e., the opposite end from the contact end portion) is latched by the latches. As a result, the card is connected to the card edge connector. The latching of the card by the latches can be released by spreading the respective latches outward.

The card is released by spreading the latches outward. The latching arms of the side frames flex to the outside. As a result, spaces that allow flexing of the latching arms are required on both sides of the card for the purpose of releasing the latching. Consequently, it is difficult to install cards side by side at a high density on the motherboard.

Another known card edge connector for connecting cards to a motherboard comprises a C-shaped first housing, which receives the contact end portion of card and is provided with a plurality of terminals, and a C-shaped second housing, which is fastened to the first housing and is provided with holding members that latch the card to a second base located on the opposite side from the terminals. The second housing is anchored and fastened to the first housing by second posts that are positioned on both outer sides of the card.

To connect a card to this second exemplary card edge connector, the contact end portion of the card is first inserted into the first housing at an inclination from above the first housing. Then, the card is rotated so that the front or opposite end portion of the card is latched by the holding members. As a result, the card is connected to the card edge connector.

Since second posts are required on both outer sides of the card, it is difficult to install cards side by side at a high density on the motherboard. Also, the overall size of the card edge connector is increased, and the number of parts required is also increased.

SUMMARY OF THE INVENTION

According to an exemplary embodiment of the present invention a card edge connector latch is provided for use with a card edge connector, which makes it possible to install cards side by side at a high density on a motherboard without increasing the overall size of the card edge connector.

A card edge connector latch is provided which makes it possible to install cards or cards side by side at a high density on a motherboard without increasing the overall size of the connector. The card edge connector latch is used together with a card edge connector that is mounted on a motherboard. The latch comprises board fasteners which are fastened to the motherboard, and latches which latch an opposite end portion of the card, a contact end portion of which is received in the card edge connector 1, in a state in which the card is substantially parallel to the motherboard. The latch is carried on and fastened to the motherboard opposite the card edge connector without being assembled with the card edge connector. The latches extend toward and engage with the opposite end portion of the card.

BRIEF DESCRIPTION OF THE DRAWINGS

An exemplary embodiment of the present invention is described below in greater detail with reference to the accompanying drawing figures, of which:

FIG. 4A is a plan view, FIG. 4B is a front view, FIG. 4C is a back view, FIG. 4D is a right-side view, FIG. 4E is a sectional view along line 4E—4E in FIG. 4B, and FIG. 4F is a sectional view along line 4F—4F in FIG. 4B;

FIG. 6A is a plan view, FIG. 6B is a front view, FIG. 6C is a back view, and FIG. 6D is a right-side view;

FIG. 7A is a plan view, FIG. 7B is a front view, FIG. 7C is a back view, FIG. 7D is a right-side view, FIG. 7E is a sectional view along line 7E—7E in FIG. 7B, and FIG. 7F is a sectional view along line 7F—7F in FIG. 7B;

FIG. 8A is a plan view of the area in the vicinity of the latches, and FIG. 8B is a right-side view;

DESCRIPTION OF THE PREFERRED EMBODIMENTS

Figure 1:
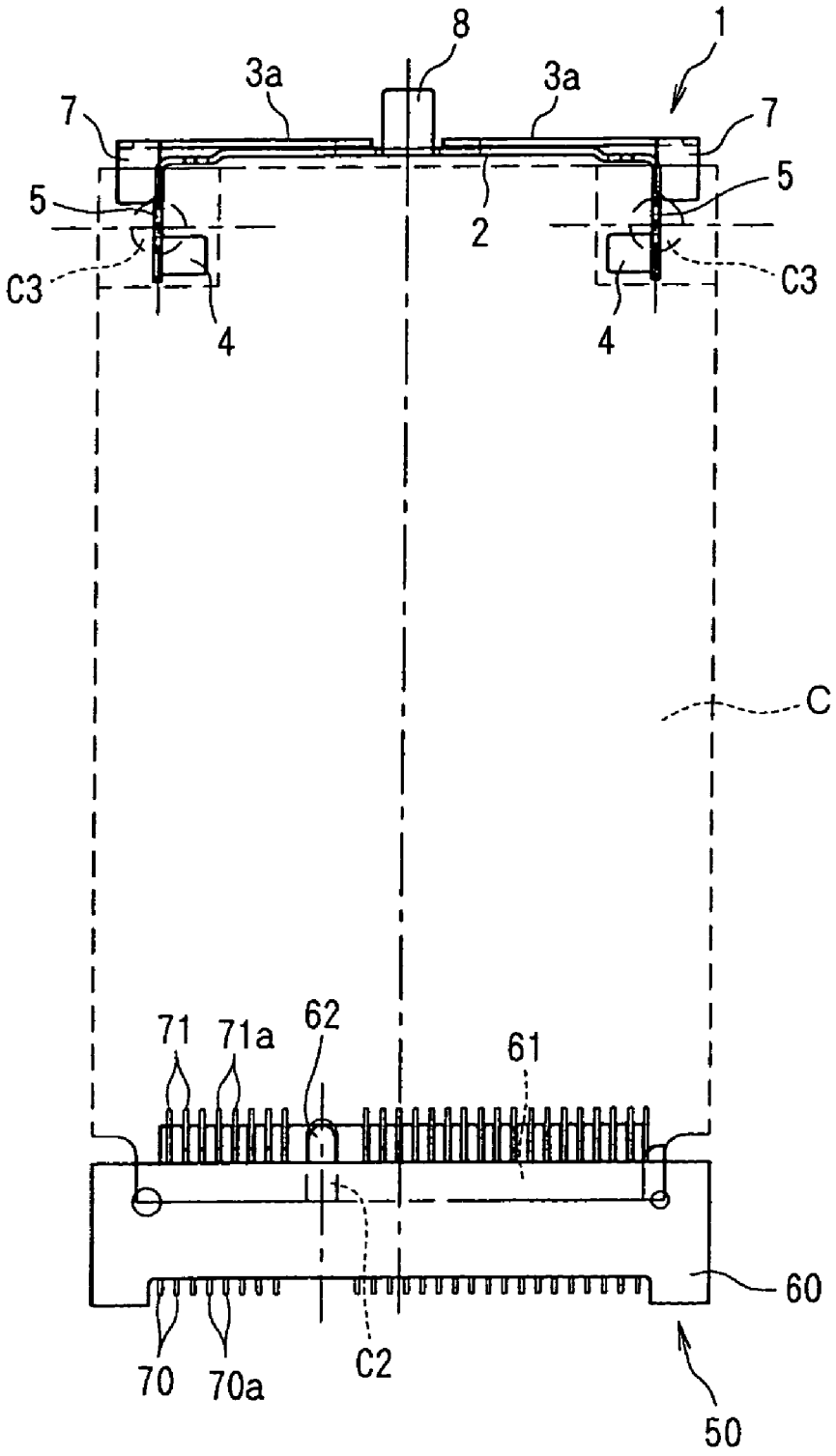
FIG. 1 is a plan view showing a card edge connector latch according to an exemplary embodiment of the present invention and a card edge connector with a card that is connected to the card edge connector and latched by the card edge connector latch indicated by a broken line.

A card edge connector latch for use with a card edge connector to install cards on a motherboard according to an exemplary embodiment of the invention is shown in FIGS. 1–5.

The card edge connector latch 1 and card edge connector 50 are mounted on a motherboard PCB (in FIG. 2) in positions that are separated from each other.

The card edge connector 50 comprises an insulating housing 60 which extends in the lengthwise direction (left-right in FIG. 1), and a plurality of contacts 70 and 71 which are attached to the housing 60 in two rows.

The housing 60 has a card receiving recess 61 extending in the lengthwise direction which opens on the front side of the housing 60 (i.e., the upper side in FIG. 1), and which receives the contact end portion of the card C. Furthermore, a keying projection 62 which is used to prevent inverted mounting of the card C is formed on the front side of the card receiving recess 61 of the housing 60 in a position that is located slightly toward the left side from the center (in the lengthwise direction) as seen from above. The housing 60 may be formed by, for example, molding an insulating synthetic resin.

The two rows of contacts 70 and 71 are constructed from rear-side contacts 70 that are press-fit into the housing 60 from the rear side of the housing 60, and front-side contacts 71 that are press-fit into the housing 60 from the front side of the housing 60. The rear-side contacts 70 and front-side contacts 71 are arranged in a mutually staggered configuration along the lengthwise direction. The rear-side contacts 70 and front-side contacts 71 respectively comprise contacts (not shown in the figures) which extend toward the inside of the card receiving recess 61 and contact the contact pads C1 (shown in FIG. 3) formed on the contact end portion of the card C. Board connects 70*a* and 71*a* are connected to the motherboard PCB, by soldering or the like. These contacts may be formed by, for example, stamping metal plates.

Meanwhile, the card edge connector latch (hereafter referred to simply as a "latch") 1 is carried on and fastened to the opposite side of the motherboard PCB from the card edge connector 50, i.e., the side of the other end portion of the card C, without being assembled with the card edge connector 50. This latch 1 may be a metal latch which is integrally formed by stamping and forming a metal plate. As is shown in FIGS. 1 and 4, this latch 1 comprises a first flat-plate 2 which extends in the lengthwise direction, and a pair of second flat-plates 3*a*, 3*a* which are folded back on the front side (the upper side in FIG. 1, i.e., the opposite side from the card edge connector 50) from the lower end of the first flat-plate 2 so that these second flat-plate overlap with the first flat-plate 2.

Figure 4A:
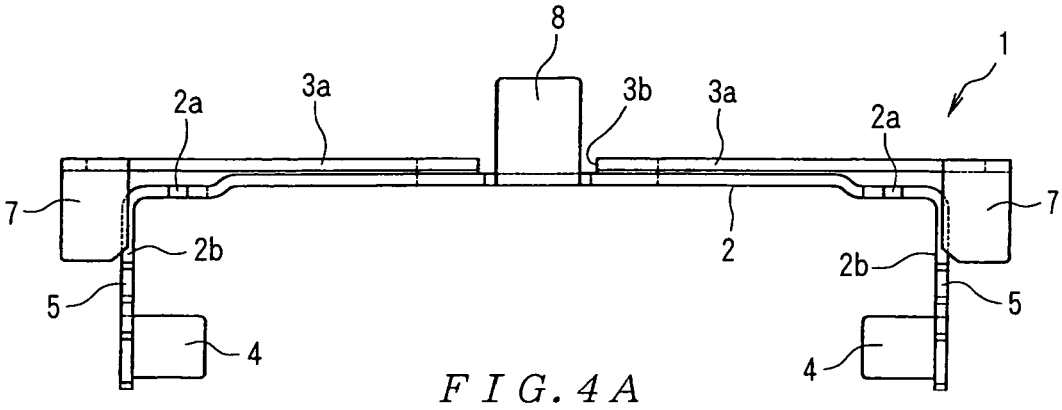
FIGS. 4A to 4F show a first embodiment of the card edge connector latch of the present invention.
Figure 4B:
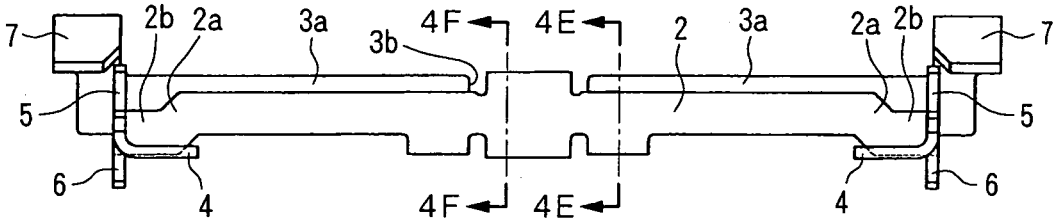
Figure 4C:
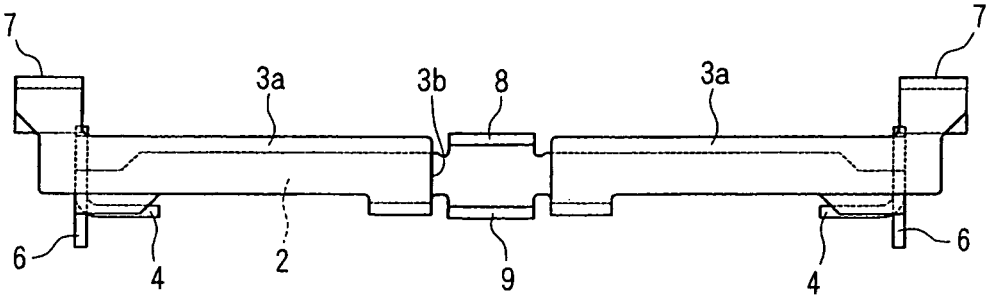
Figure 4D:
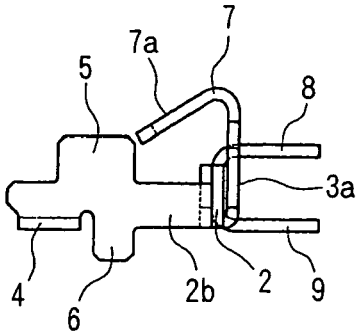
Figure 4E:
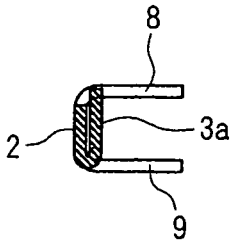
Figure 4F:
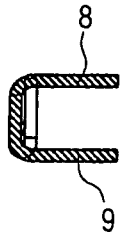

A pair of latches 7, 7 which latch the card C in a state substantially parallel to the motherboard PCB are formed so that these latches 7, 7 protrude upward on both ends of the second flat-plates 3*a*, 3*a* (in the lengthwise direction). The respective latches 7 extend forward, i.e., toward the rear or opposite end portion of the card C that is opposite the contact end portion of the card C received in the card edge connector 50. The latches 7 engage with this opposite end portion. As is shown in FIG. 4D, the respective latches 7 first extend upward from both ends of the second flat-plates 3*a*, 3*a* (in the lengthwise direction), and are then bent so that these latches 7 extend downward at an inclination toward the rear. Furthermore, an opening 3*b* which allows extension of the vacuum pick-up surface 8 (described later) is formed between the pair of second flat-plates 3*a*, 3*a*.

A pair of inclined plates 2*a* that extend downward at an inclination are formed on both ends (one on each end in the lengthwise direction) of the first flat-plate 2, and a pair of rearward-extensions 2*b* are also formed which first extend outward in the lengthwise direction from both ends of the inclined plates 2*a* and then extend to the rear in a direction perpendicular to the lengthwise direction. Positioning posts 6 protrude from the lower ends of substantially the central portions (in the forward-rearward direction) of the respective rearward-extensions 2*b* for positioning the latch 1 on the motherboard PCB by being inserted into positioning holes 10 formed in the motherboard PCB. Board fasteners 4 for fastening the latch 1 to the motherboard PCB are formed so that they are bent inward in positions on the respective rearward-extensions 2*b* that are located further to the rear than the positioning posts 6. Latch projections 5 position the card C by being inserted into holes C3 (described later) which are formed in the vicinity of the corners of the card C. The latch projections 5 protrude upward on the upper ends of substantially the central portions (in the forward-rearward direction) of the respective rearward-extensions 2*b*. A vacuum pick-up surface 8, which extends forward, i.e., in the opposite direction from the latches 7, is formed on the center (in the lengthwise direction) of the first flat-plate 2. The vacuum pick-up surface 8 may be constructed from a flat-plate which extends forward from the upper end of the center (in the lengthwise direction) of the first flat-plate 2, and functions as a vacuum pick-up surface during the automatic mounting of the latch 1 on the motherboard PCB by an automated mounting apparatus. Extending from the lower end of the center (in the lengthwise direction) of the first flat-plate 2 parallel to the vacuum pick-up surface 8 is a third board fastener 9. Thus, board fasteners 4 and 9 are disposed in three places on the latch 1 with a good balance in the forward-rearward and left-right directions.

Figure 3:
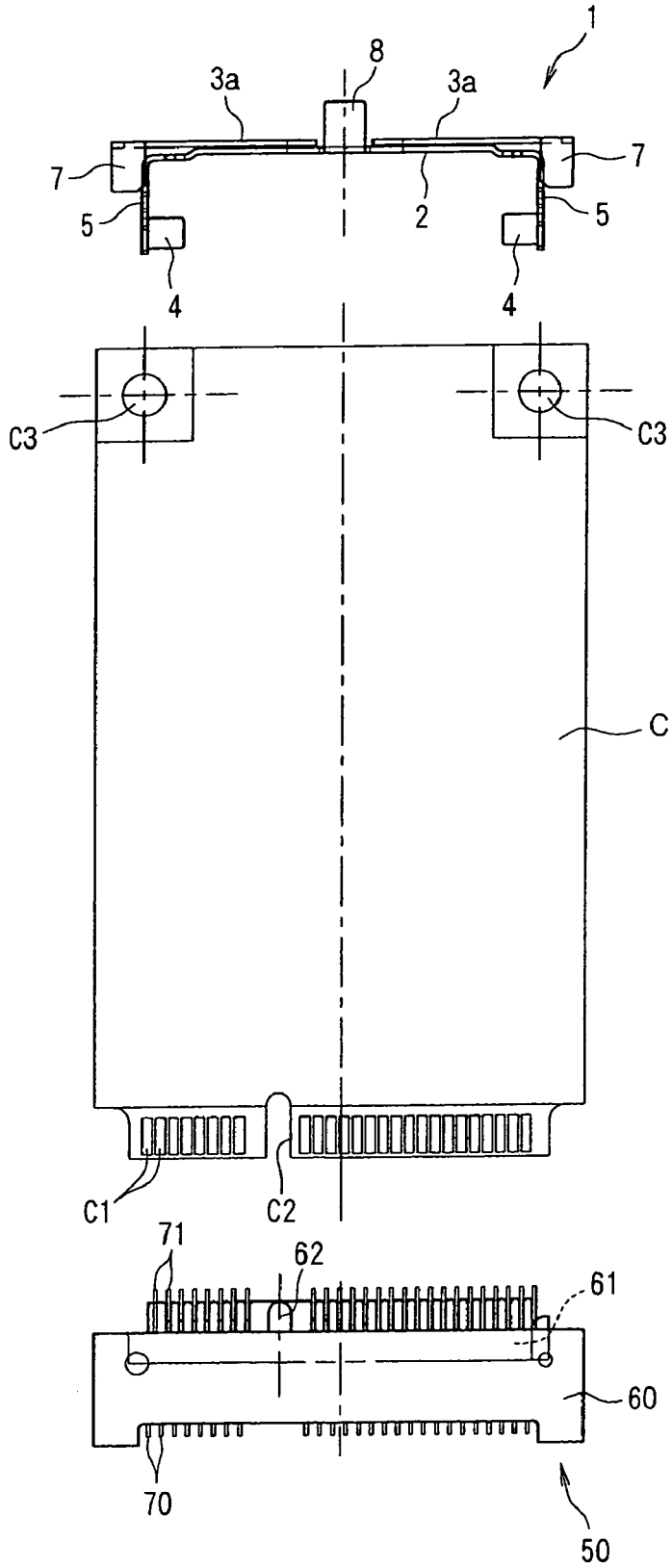
FIG. 3 is an exploded view showing the card edge connector latch, card edge connector and card shown in FIG. 1.

Furthermore, as is shown most clearly in FIG. 3, the card C has a substantially planer shape with a width that is substantially comparable to the width of the housing 60, and has a plurality of contact pads C1 on the upper surface and undersurface of contact end portion. Moreover, a cut-out C2 is formed in the contact end portion of the card C in a position that is slightly to the left of the center of the card C (in the lengthwise direction). When the contact end portion of the card C is inserted into the card receiving recess 61 keying projection 62 formed on the housing 60 is inserted into the cut-out C2, allowing the contacts 70A, 71*a* to contact the contact pads C1, when the one end portion of the card C. Furthermore, a plurality of holes C3 (two holes in the present embodiment) into which the latch projections 5 of the latch 1 are inserted are formed in the vicinity of the corners of the opposite end portion of the card C located on the opposite end from the contact end portion.

Next, the method for connecting the card C to the motherboard PCB will be described with reference to FIGS. 1 and 2.

Prior to the connection of the card C to the motherboard PCB, the card edge connector 50 is mounted on the motherboard PCB, and the latch 1 is carried on and fastened to the motherboard PCB opposite the card edge connector 50. The latch 1 may be mounted on the motherboard PCB by automatic mounting. This may be accomplished, for example, by causing suction chucking of the vacuum pick-up surface 8 by means of an automated mounting apparatus. Then, the board fasteners 4 and 9 are connected to the motherboard PCB by soldering in order to fasten the latch 1 to the motherboard PCB.

Figure 2:
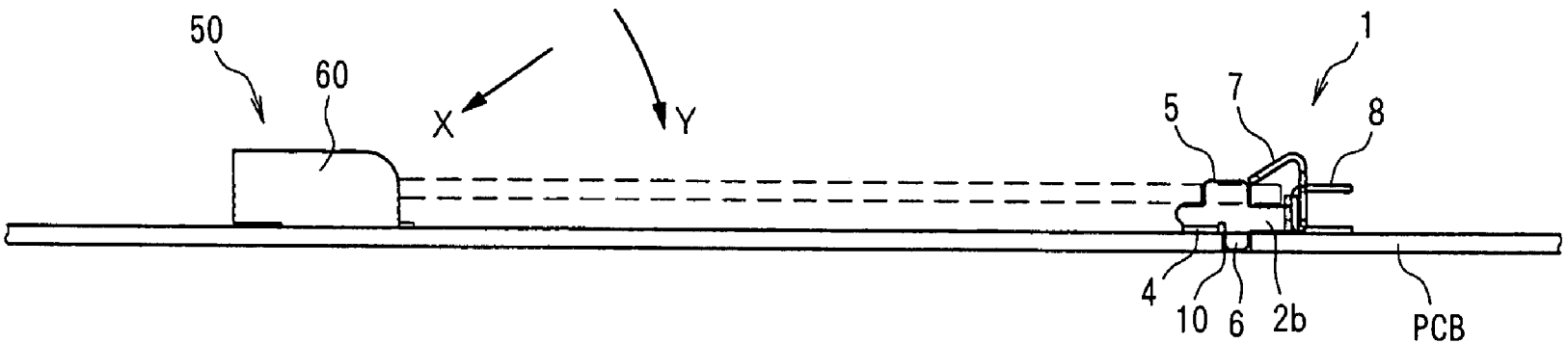
FIG. 2 is a side view of the card edge connector latch and card edge connector of FIG. 1, mounted on a printed motherboard.

Next, the card C is caused to advance at an inclination as indicated by the arrow X in FIG. 2, so that the contact end portion of the card C is inserted into the card receiving recess 61 of the housing 60. As a result, the contacts of the rear-side contacts 70 and front-side contacts 71 contact the contact pads C1 formed on the card C, so that the card C and motherboard PCB are electrically connected. During this insertion of the card C, the keying projection 62 formed on the housing 60 enters the cut-out C2 formed in the card C. In this insertion of the card C, if the card C is inserted upside down, the keying projection 62 will not enter the cut-out C2 (since the keying projection 62 and cut-out C2 are formed in positions that are shifted from the center in the lengthwise direction). Accordingly, inverted mounting of the card C is prevented.

Moreover, after the contact end portion of the card C is inserted into the card receiving recess 61, the card C is rotated about the contact end portion in the direction indicated by the arrow Y in FIG. 2 until the card C is oriented substantially parallel to the motherboard PCB. As a result, the other end portion of the card C is latched by the latches 7 of the latch 1 so that the movement of the card C in the upward direction is restricted, and the substantially parallel state of the card C with respect to the motherboard PCB is maintained. When the card C is rotated in the direction indicated by arrow Y, the latch projections 5 are inserted into the holes C3 formed in the card C, so that the card C is positioned, and so that the movement of the card C in the forward-rearward direction is restricted. In the latching of the opposite end portion of the card C by the latches 7, this opposite end portion contacts the inclined upper surfaces 7*a* of the latches 7 as a result of the rotation of the card C, so that the second flat-plates 3*a* on which the latches 7 are disposed temporarily flex in the forward direction. Then, when the other end portion of the card C passes the latches 7, the latches 7 recover to their original state and are positioned on the opposite end portion of the card C. As a result, the connection of the card C to the motherboard PCB is completed.

The latching of the card C by the latch 1 can be released by causing the second flat-plates 3*a* on which the latches 7 are disposed to flex in the forward direction. As a result, the opposite end portion of the card C is caused to rotate upward about the contact end portion of the card C by the elastic force of the contacts 70 and 71, so that the latching is released.

Figure 5:
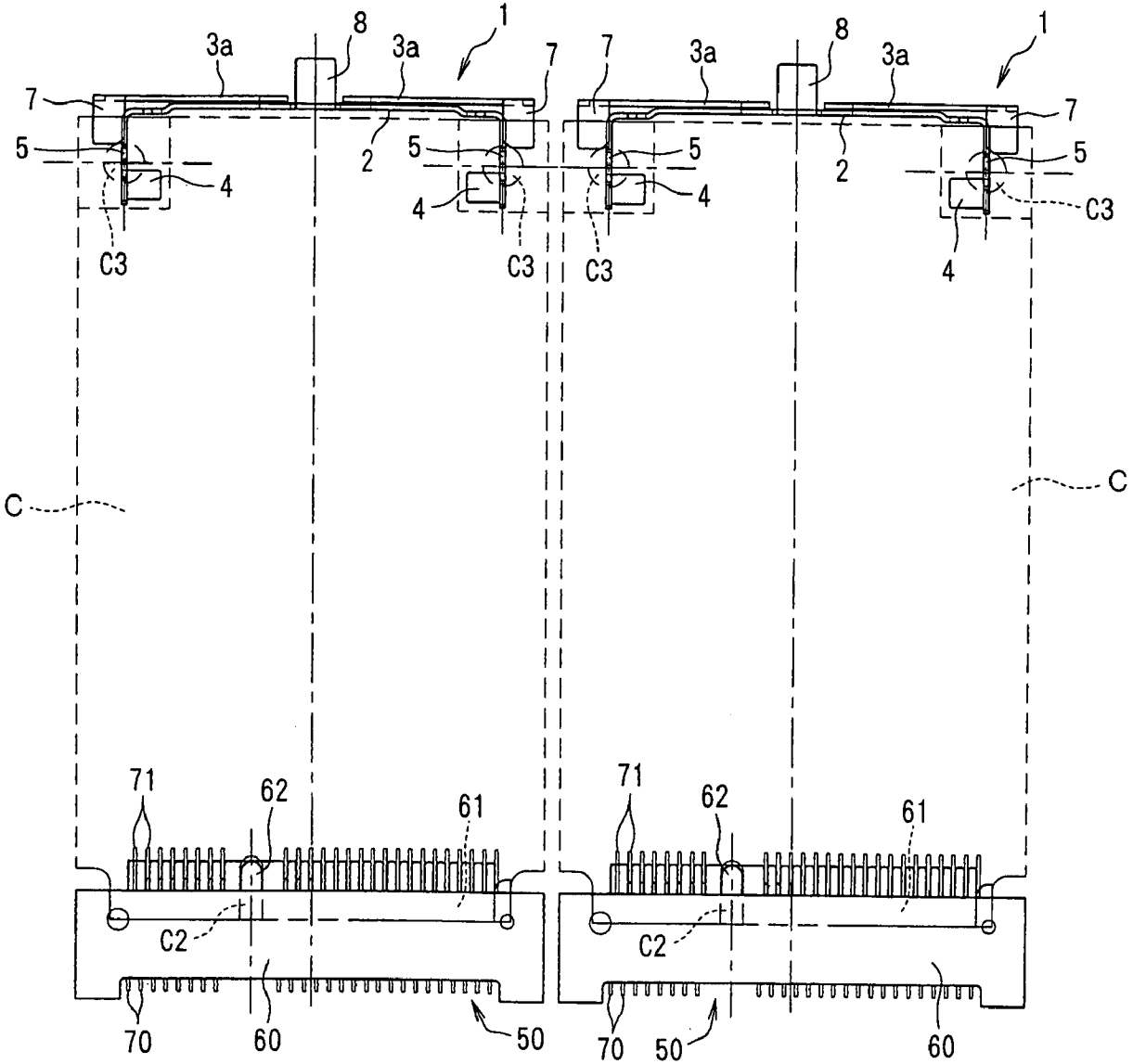
FIG. 5 is a plan view showing a plurality of card edge connector latches and card edge connectors mounted side by side on a motherboard, so that the cards, indicated by broken lines, are mounted side by side on the motherboard.

In the present embodiment, the latch 1 is carried on and fastened to the motherboard PCB without being assembled with the card edge connector 50. Furthermore, the latches 7 extend toward and engage with the opposite end portion that is opposite the contact end portion of the card C that is received in the card edge connector 50. Accordingly, there is no need for spaces to allow flexing of the latches 7 on both outer sides of the card C or for members for the latching of the card on both outer sides of the card C. Consequently, as is shown in FIG. 5, in cases where cards C are mounted side by side on the motherboard PCB, these cards C can be mounted side by side at a high density without increasing the overall size of the connector. Also, if the latch 1 is made of metal, the retaining strength of the cards C against impacts is increased, and the cards C can also be grounded via the latches 7 or rearward-extensions 2*b*.

Since the latch 1 has a vacuum pick-up surface 8 that extends in the opposite direction from the latches 7 in the center (in the lengthwise direction) of the first flat-plate 2, the latch 1 can be automatically mounted on the motherboard PCB by an automated mounting apparatus.

Also, since latch projections 5 which position the card C by being inserted into holes C3 formed in the vicinity of the corners of the opposite end portion of the card C are disposed in the vicinity of the latches 7, the card C can easily be positioned.

Next, a second embodiment of the card edge connector latch of the present invention will be described with reference to FIGS. 6A to 6D.

Like the latch 1 shown in FIGS. 1 through 5, the card edge connector latch (hereafter referred to simply as a "latch") 81 shown in FIGS. 6A to 6D is carried on and fastened to the motherboard PCB on the opposite side of the motherboard from the card edge connector 50, i.e., on the side of the opposite end portion of the card C, without being assembled with the card edge connector 50.

The basic construction of the latch 81 is similar to that of the latch 1. This latch 81 may be a metal latch which is integrally formed by stamping and forming a metal plate. As is shown in FIGS. 6A to 6D, this latch comprises a first flat-plate 82 which extends in the lengthwise direction, and a pair of second flat-plates 83*a*, 83*a* which are folded back on the front side (the upper side in FIG. 6A, i.e., the opposite side from the card edge connector 50) from the lower end of the first flat-plate 82 so that these second flat-plates overlap with the first flat-plate 82.

Figure 6A:
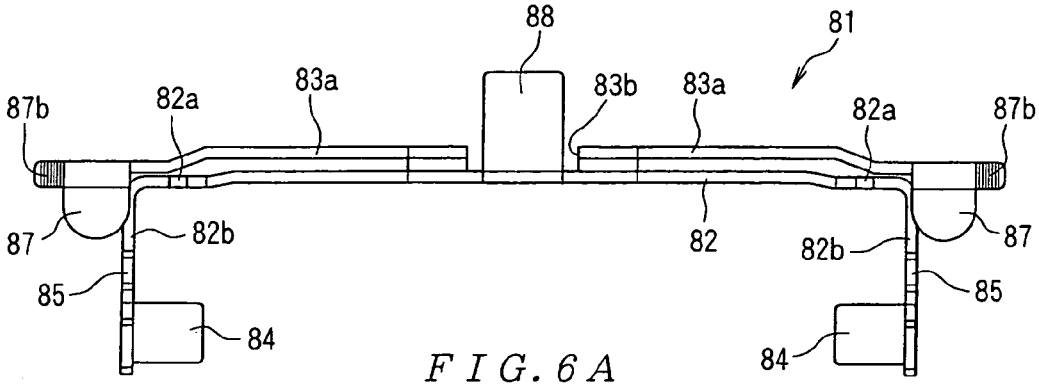
FIGS. 6A to 6D show a second exemplary embodiment of the card edge connector latch of the present invention.
Figure 6B:
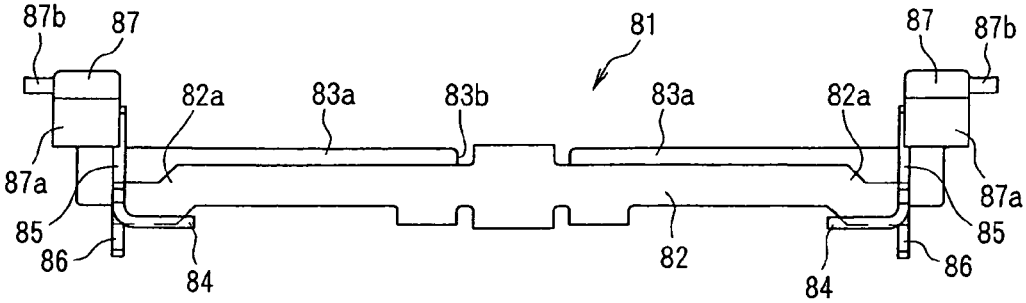
Figure 6C:
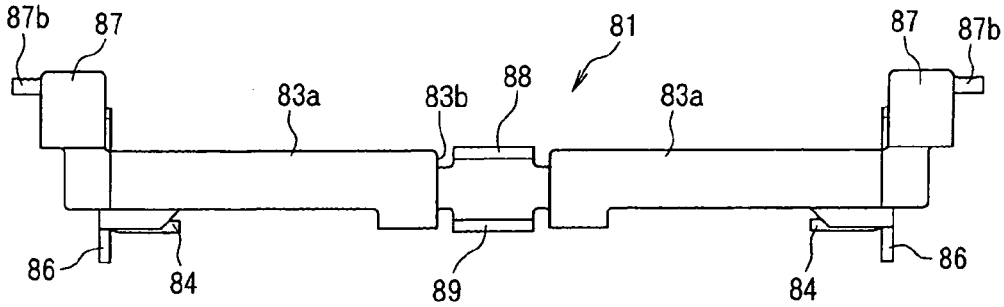
Figure 6D:
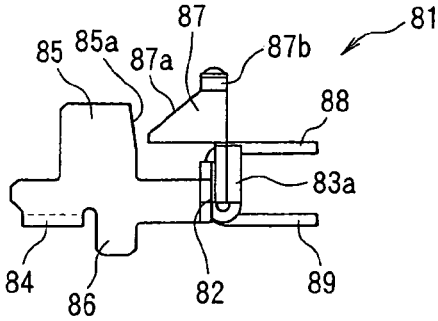

Here, a pair of latches 87, 87 which latch the card C in a state substantially parallel to the motherboard PCB are disposed so that these latches protrude upward on both ends (in the lengthwise direction) of the second flat-plates 83*a*, 83*a*. The respective latches 87 extend toward and engage with the opposite end portion of the card C, opposite the contact end portion of the card C received in the card edge connector 50. When the latches 87 engage with the opposite end portion of the card C, the movement of the card C in the upward direction is restricted, so that the substantially parallel state of the card C with respect to the motherboard PCB is maintained. The respective latches 87 differ from the latches 7 of the latch 1 shown in FIGS. 1 through 5 in that these latches 87 are formed by molding, such as injection molding of a resin. As is shown in FIG. 6D, the rear surfaces of the respective latches 87 are formed as inclined surfaces 87*a* that incline downward toward the rear at an angle. Furthermore, operating portions 87*b* that protrude outward are disposed on the upper ends of the outside surfaces of the respective latches 87. The latching of the latches 87 with the opposite end portion of the card C can be released by grasping the operating portions 87*b* with the fingers and moving these operating portions in the forward direction. Since the latches 87 are thus formed by molding, the degree of freedom in the shape of the latches 87 can be increased compared to a case in which the latches are formed by forming metal plates. Accordingly, for example, the operating portions 87*b* that move the latches 87 in the direction that releases the latched state effected by the latches 87 can easily be formed. Furthermore, unlike latches that are formed by stamping and forming metal plates, these latches 87 have no cut surfaces; accordingly, the risk of injury to the fingers of the operator operating the latches and damage to the card C are reduced.

An opening 83*b* which allows the extension of the vacuum pick-up surface 88 is formed between the pair of second flat-plates 83*a*, 83*a*. Moreover, a pair of inclined plates 82*a* which extend downward at an inclination are formed on both ends (one on each in the lengthwise direction) of the first flat-plate 82, and a pair of rearward-extensions 82*b* are also formed which first extend outward in the lengthwise direction from both ends of the inclined plates 82*a*, and then extend rearward in the direction perpendicular to this lengthwise direction. Positioning posts 86 for positioning the latch 81 on the motherboard PCB by being inserted into positioning holes 10 formed in the motherboard PCB are formed so that these posts protrude from the lower ends of substantially the central portions (in the forward-rearward direction) of the respective rearward-extensions 82*b*. Board fasteners 84 for fastening the latch 81 to the motherboard PCB are formed so that they are bent inward in positions on the respective rearward-extensions 82*b* that are located further to the rear than the positioning posts 86. In addition, projections 85 which position the card C by being inserted into holes C3 formed in the vicinity of the corners of the opposite end portion of the card C are formed so that these projections protrude upward on the upper ends of substantially the central portions (in the forward-rearward direction) of the respective rearward-extensions 82*b*. When the projections 85 of the latch 81 are inserted into the holes C3 formed in the card C, the card C is positioned, and the movement of the card C in the forward-rearward direction is restricted. Inclined surfaces 85*a* which are inclined upward toward the rear at an angle are formed on the front-side surfaces of the projections 85. When the latching of the card C by the latch 81 is to be released, the opposite end portion of the card C rotates upward about the contact end portion of the card C; in this case, as a result of the formation of these inclined surfaces 85*a*, the inside walls of the holes C3 on the side of the opposite end portion of the card C do not interfere with the projections 85, so that the rotation of the card C can be accomplished in a smooth manner. Furthermore, a vacuum pick-up surface 88 which extends forward, i.e., in the opposite direction from the latches 87, is formed on the center (in the lengthwise direction) of the first flat-plate 82. The vacuum pick-up surface 88 is constructed from a flat-plate which extends forward from the upper end of the center (with respect to the lengthwise direction) of the first flat-plate 82, and functions as a vacuum pick-up surface during the automatic mounting of the latch 81 on the motherboard PCB by an automated mounting apparatus. Furthermore, a third board fastener 89 extends from the lower end of the center (with respect to the lengthwise direction) of the first flat-plate 82 parallel to the vacuum pick-up surface 88. Thus, board fasteners 84 and 89 are disposed in three places on the latch 81 with a good balance in the forward-rearward and left-right directions.

In the present embodiment, the latch 81 is carried on and fastened to the motherboard PCB without being assembled with the card edge connector 50, and the latches 87 extend toward and engage with the opposite end portion that is opposite the contact end portion of the card C that is received in the card edge connector 50. Accordingly, there is no need for spaces to allow flexing of the latches 87 on both outer sides of the card C. Furthermore, there is no need for members for the latching of the card on both outer sides of the card C. Consequently, in cases where cards C are mounted side by side on the motherboard PCB, these cards C can be mounted side by side at a high density without increasing the overall size of the connector.

Also, since the latch 81 comprises a vacuum pick-up surface 88 which extends in the opposite direction from the latches 87 in the center (with respect to the lengthwise direction) of the first flat-plate 82, the latch 81 can be automatically mounted on the motherboard PCB by an automated mounting apparatus.

Also, since projections 85 which position the card C by being inserted into holes C3 formed in the vicinity of the corners of the opposite end portion of the card C are disposed in the vicinity of the latches 87, the card C can easily be positioned.

Next, a third embodiment of the card edge connector latch of the present invention will be described with reference to FIGS. 7A to 7F through 9.

Like the latch 1 shown in FIGS. 1 through 5, the card edge connector latch (hereafter referred to simply as a "latch") 91 shown in FIGS. 7A to 7F is also carried on and fastened to the motherboard PCB on the opposite side of the motherboard from the card edge connector 50, i.e., on the side of the opposite end portion of the card C, without being assembled with the card edge connector 50.

The basic construction of the latch 91 is similar to that of the latch 1. This latch 91 may be a metal latch which is integrally formed by stamping and forming a metal plate. As is shown in FIGS. 7A to 7F, this latch comprises a first flat-plate 92 which extends in the lengthwise direction (the left-right direction in FIG. 7A), and a pair of second flat-plates 93*a*, 93*a* which are folded back on the front side (the upper side in FIG. 7A, i.e., the opposite side from the card edge connector 50) from the lower end of the first flat-plate 92 so that these second flat-plates overlap with the first flat-plate 92.

Figure 7A:
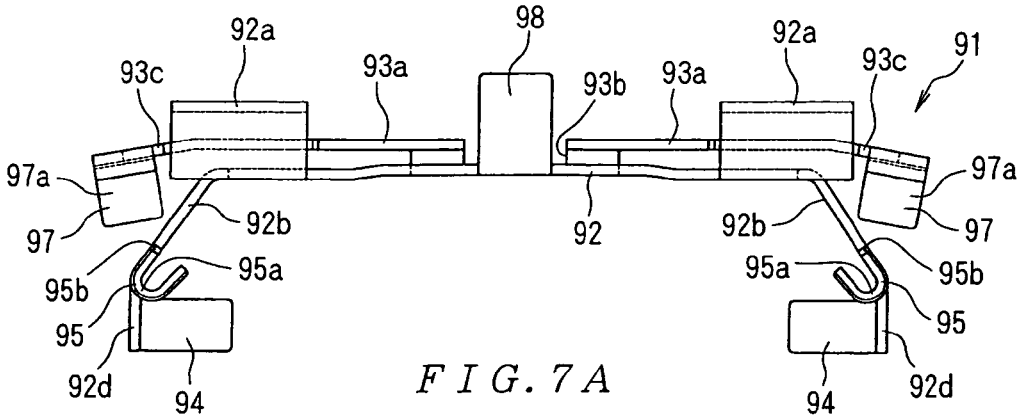
FIGS. 7A to 7F show a third exemplary embodiment of the card edge connector latch of the present invention.
Figure 7B:
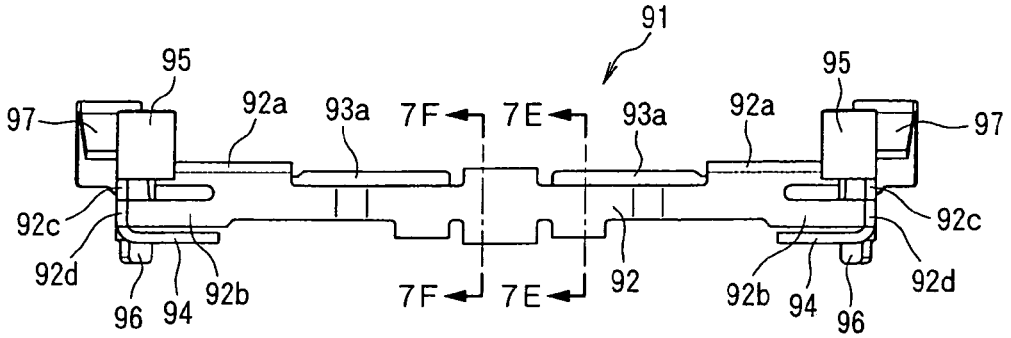
Figure 7C:
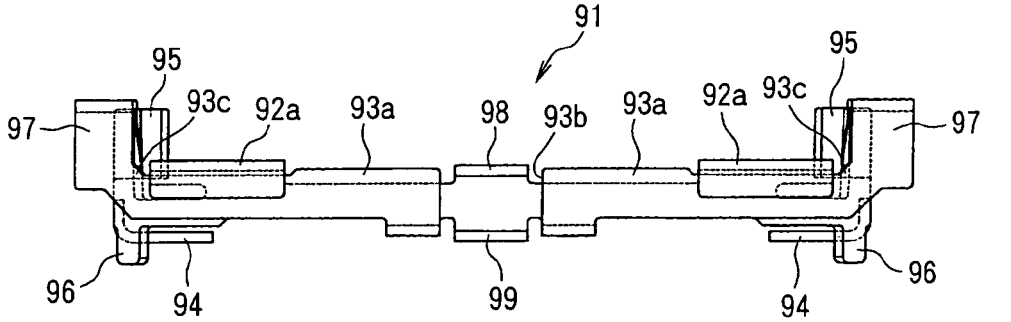
Figure 7D:
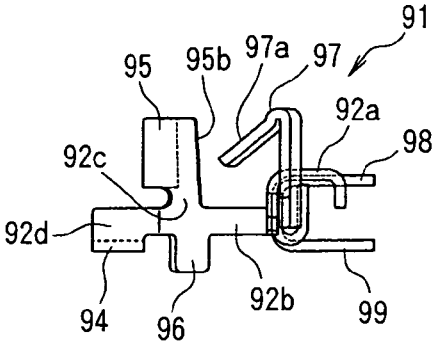
Figure 7E:
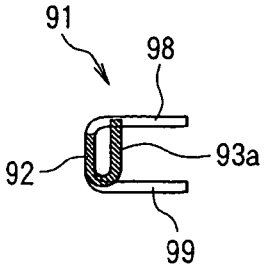
Figure 7F:
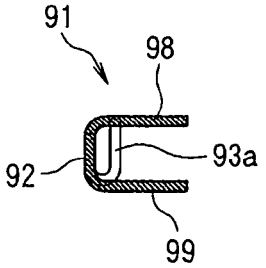

A pair of latches 97, 97 which latch the card C in a state substantially parallel to the motherboard PCB are disposed so that these latches protrude upward on both ends (with respect to the lengthwise direction) of the second flat-plates 93*a*, 93*a*. The respective latches 97 extend toward and engage with the opposite end portion that is opposite the contact end portion of the card C received in the card edge connector 50. As is shown in FIG. 7A, the respective latches 97 first extend upward via inclined portions 93*c* that extend upward at an inclination and forward and outward at an inclination from both ends (with respect to the lengthwise direction) of the second flat-plates 93*a*, 93*a*; these latches 97 are then bent so as to extend downward at an inclination toward the rear. Also, an opening 93*b* is formed between the pair of second flat-plates 93*a*, 93*a* in order to allow extension of the vacuum pick-up surface 98 (described later).

The latch 91 differs from the latch 1 shown in FIGS. 1 through 5 in that a pair of anti-overstress stops 92*a* which are bent forward from the upper end of the first flat-plate 92 are disposed on both ends (one on each end with respect to the lengthwise direction) of the first flat-plate 92. The respective anti-overstress stops 92*a* extend over the second flat-plates 93*a*, and prevent excessive displacement of the respective latches 97 in the direction that releases the engagement with the opposite end portion of the card C. Furthermore, a pair of rearward-extensions 92*b* which extend outward at an inclination toward the rear are formed on both ends (one on each end with respect to the lengthwise direction) of the first flat-plate 92. Positioning posts 96 for positioning the latch 91 on the motherboard PCB by being inserted into positioning holes 10 formed in the motherboard PCB are formed so that these posts protrude from the lower ends of the rear end portions of the respective rearward-extensions 92*b*.

Projections 95 which position the card C by being inserted into holes C3 formed in the vicinity of the corners of the opposite end portion of the card C are formed on the upper ends of the rear end portions of the respective rearward-extensions 92*b* so that these projections 95 protrude via extensions 92*c* that extend upward. As is shown in FIG. 7A, these projections 95, unlike the latch projections 5 of the latch 1 shown in FIGS. 1 through 5, are formed into a curved shape, such that the projections 95 first extend rearward in the same direction as the direction of extension of the rearward-extensions 92*b*, and are then folded back via bends 95*a* so that these projections 95 are oriented parallel to the direction of extension of the rearward-extensions 92*b*. Inclined surfaces 95*b* which are inclined upward at an angle toward the rear are formed on the front-side surfaces of the projections 95. When the latching of the card C by the latch 91 is to be released, the opposite end portion of the card C is rotated upward about the contact end portion of the card C; in this case, as a result of the formation of the inclined surfaces 95*b*, the rotation of the card C can be smoothly accomplished without any interference of the inside walls of the holes C3 on the side of the opposite end portion of the card C with the projections 95. Furthermore, extensions 92*d* extend rearward in a direction perpendicular to the first flat-plate 92 from the rear end portions of the respective rearward-extensions 92*b*, and board fasteners 94 for fastening the latch 91 to the motherboard PCB are formed on the lower ends of these extensions 92*d* so that these board fasteners 94 are bent inward. Moreover, a vacuum pick-up surface 98 which extends forward is formed on the center (with respect to the lengthwise direction) of the first flat-plate 92. The vacuum pick-up surface 98 is constructed from a flat-plate which extends forward from the upper end of the center (with respect to the lengthwise direction) of the first flat-plate 92, and functions as a vacuum pick-up surface during the automatic mounting of the latch 91 on the motherboard PCB by an automated mounting apparatus. Furthermore, a third board fastener 99 extends from the lower end of the center (with respect to the lengthwise direction) of the first flat-plate 92 parallel to the vacuum pick-up surface 98. Thus, board fasteners 94 and 99 are disposed in three places on the latch 91 with a good balance in the forward-rearward and left-right directions.

Figure 8A:
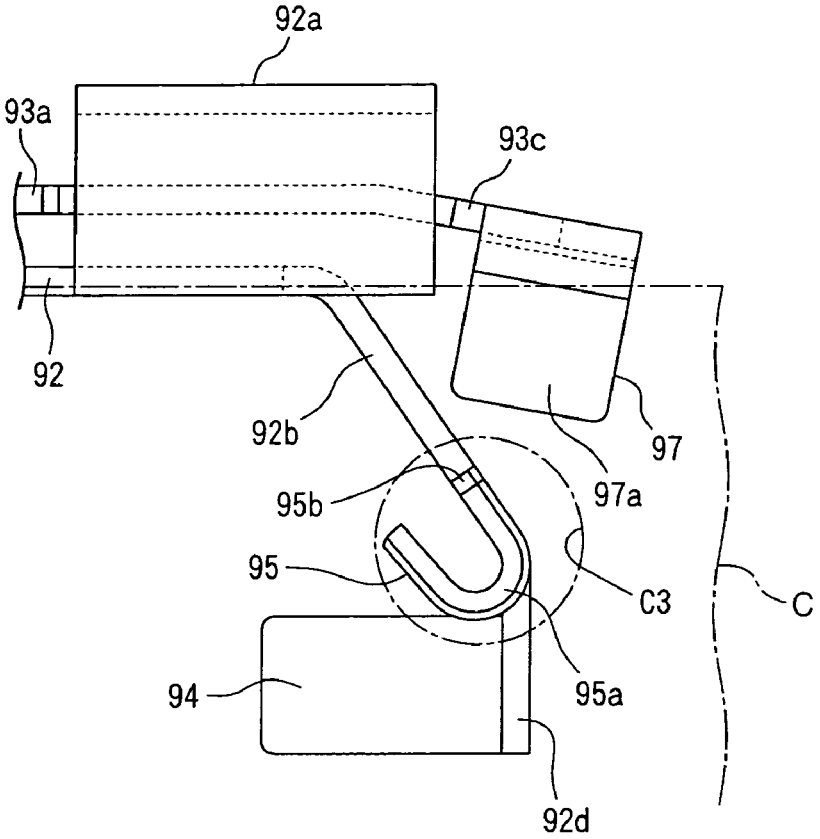
FIGS. 8A and 8B show a state in which the latch shown in FIGS. 7A to 7F is latched to the card by the latches.
Figure 8B:
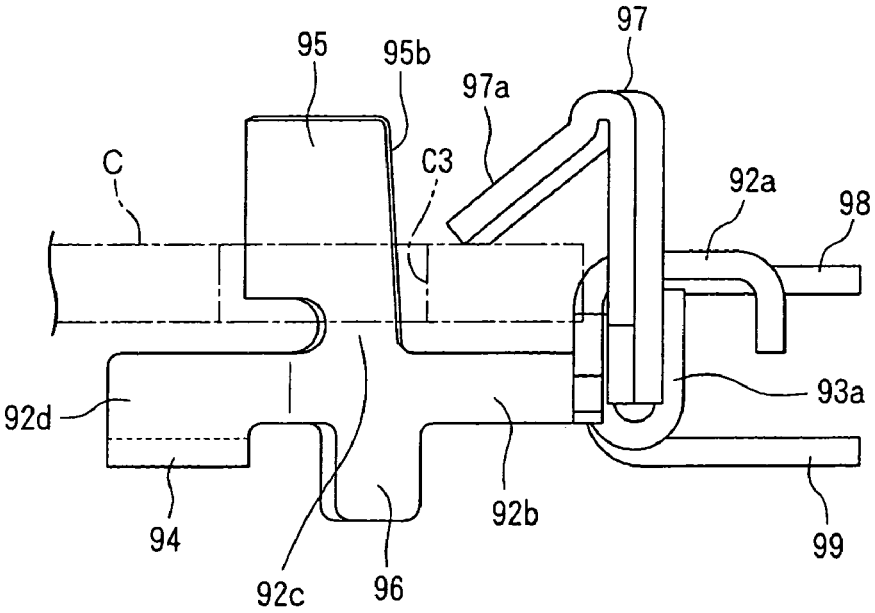

When the card C is to be connected to the motherboard PCB, the contact end portion of the card C is inserted into the card receiving recess 61 of the card edge connector 50, and the card C is then rotated about the contact end portion until the card C is substantially parallel to the motherboard PCB (see FIG. 2). As a result, the opposite end portion of the card C is latched by the latches 97 of the latch 91, so that the movement of the card C in the upward direction is restricted, and the substantially parallel state of the card C with respect to the motherboard PCB is maintained (see FIG. 8B). In this state, the projections 95 of the latch 91 are inserted into the holes C3 formed in the card C, so that the card C is positioned, and so that the movement of the card C in the forward-rearward direction is restricted (see FIG. 8A). Since the projections 95 that position the card C are formed in a curved shape, the movement of the card C not only in the forward-rearward direction but also in the left-right direction can be restricted in a relatively favorable manner (as shown in FIG. 8A) after the card C has been positioned by the insertion of the projections 95 into the holes C3 in the card C. Accordingly, if projections 95 formed in a curved shape are used, positional deviation of the card C caused by vibration or impacts, etc., can be reduced. Furthermore, since the curved shapes of the projections 95 can contact the edges of the holes C3 in the card C when the card C is positioned, damage to the card C can be avoided.

In the latching of the opposite end portion of the card C by the latches 97, this opposite end portion contacts the inclined upper surfaces 97*a* of the latches 97 as a result of the rotation of the card C, so that the second flat-plates 93*a* on which the latches 97 are disposed temporarily flex toward the front. Then, when the opposite end portion of the card C passes the latches 97, the latches 97 recover to their original state, so that these latches 97 are positioned on the opposite end portion of the card C. As a result, the connection of the card C to the motherboard PCB is completed.

Figure 9:
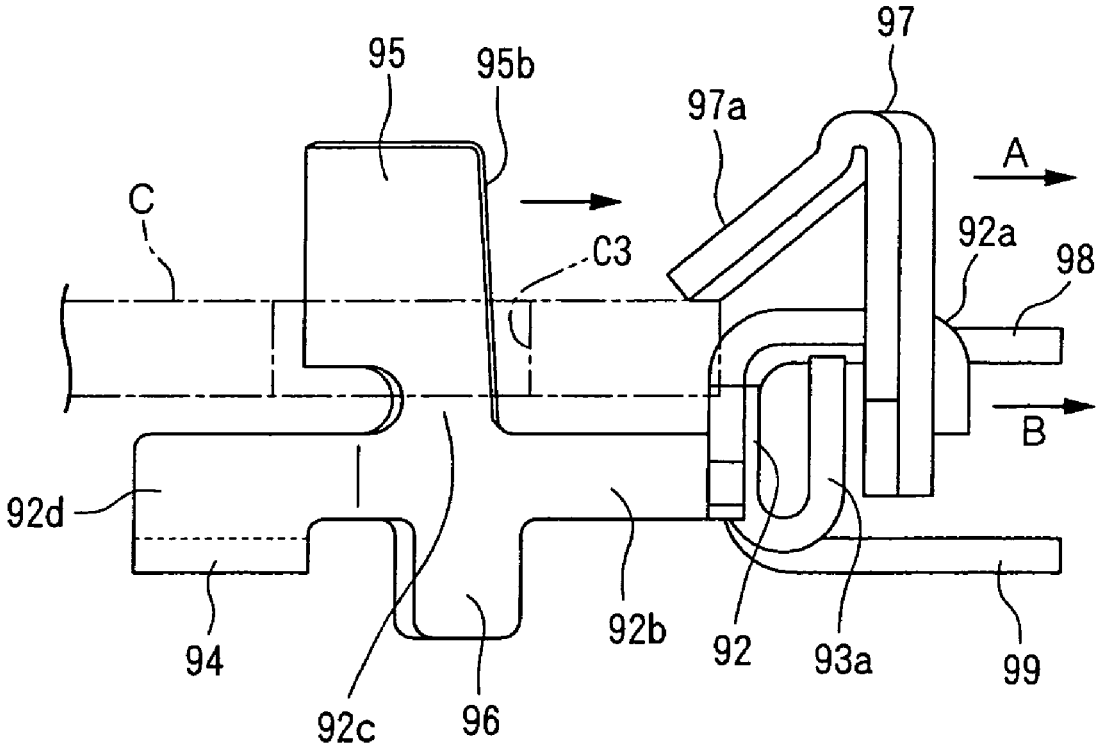
FIG. 9 is a right-side view showing a state in which the latched state of the latch (shown in FIGS. 7A to 7F) to the card by the latches is being released.
Figure 10:
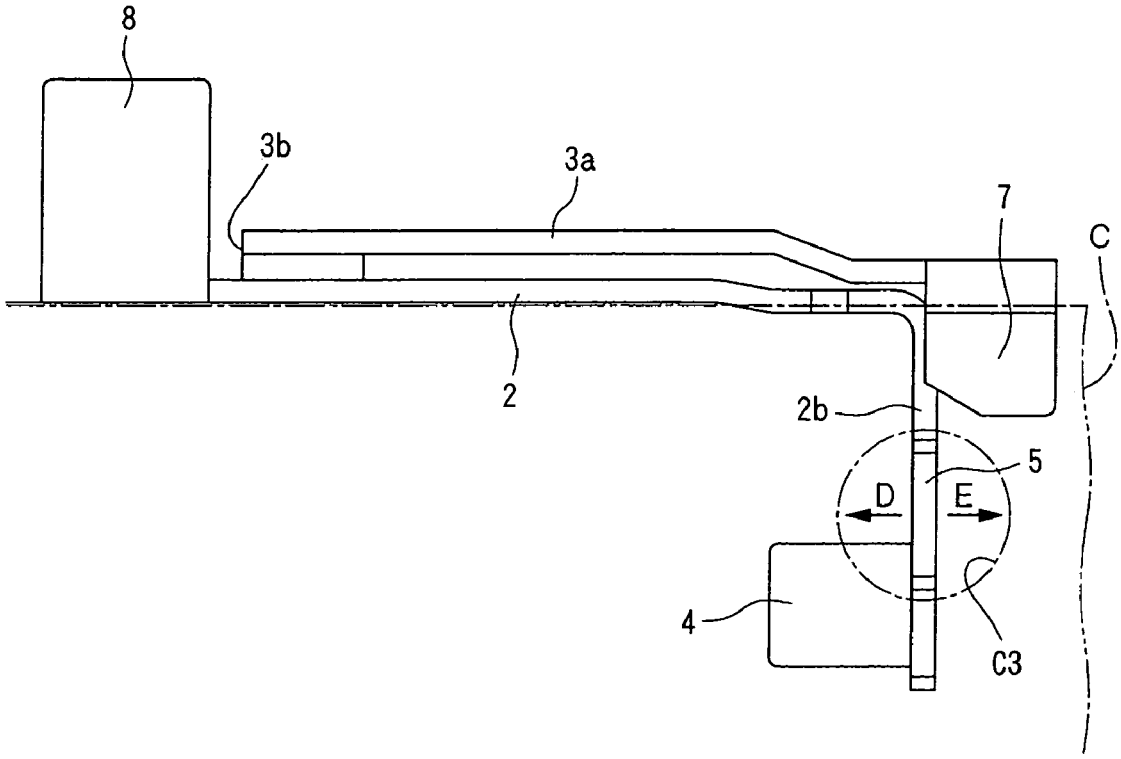
FIG. 10 is a plan view of the area in the vicinity of the latches showing a state in which the latch shown in FIGS. 1 through 5 is latched to the card by the latches.
Figure 11:
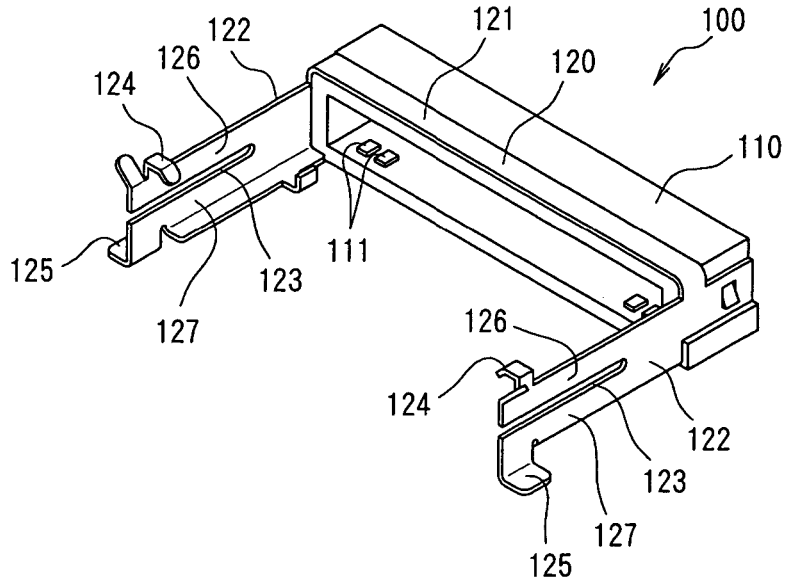
FIG. 11 is a perspective view which shows a known card edge connector.
Figure 12:
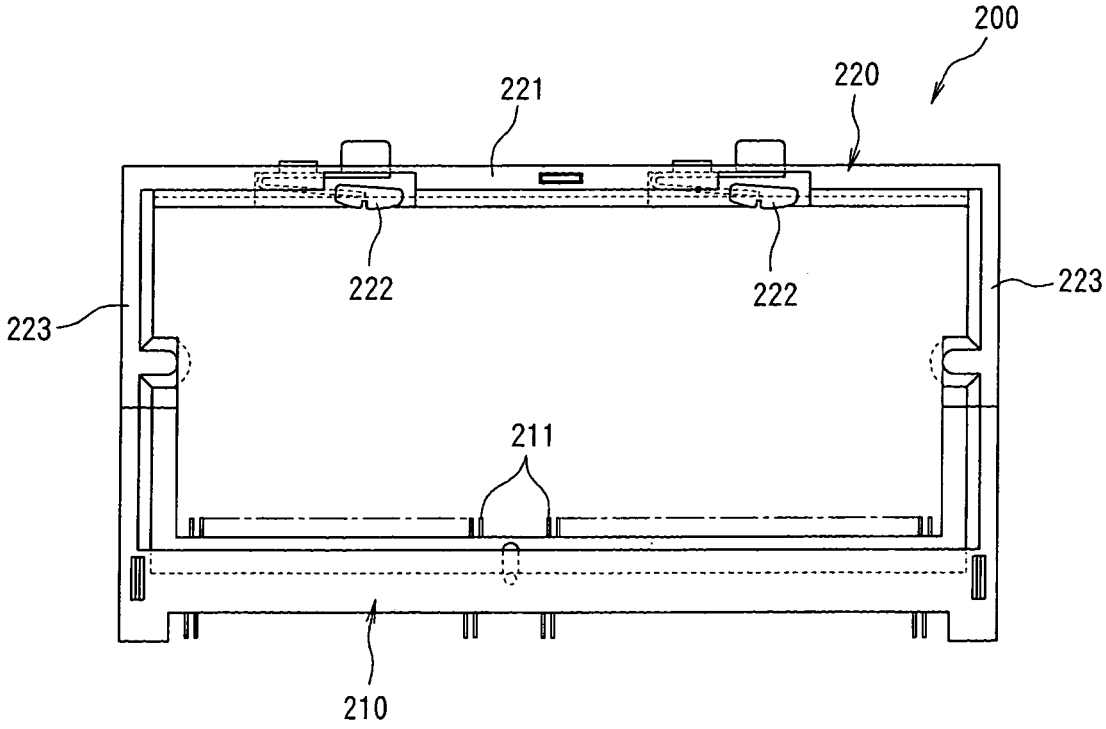
FIG. 12 is a plan view which shows another known card edge connector.

The latching of the card C by the latch 91 can be released by moving the latches 97 forward as indicated by the arrow A so that the second flat-plates 93*a* on which the latches 97 are disposed are caused to flex toward the front as shown in FIG. 9. As a result, the opposite end portion of the card C is caused to rotate upward about the contact end portion of the card C by the elastic force of the contacts 70 and 71 (see FIG. 1), so that the latching is released. In the release of this latching, as is shown in FIG. 9, the second flat-plates 93*a* on which the latches 97 are disposed contact the anti-overstress stops 92*a*, so that excessive displacement of the latches 97 in the direction that releases the engagement of the latches 97 is prevented. Accordingly, excessive stress is prevented from being applied to the latches 97, so that plastic deformation of the latches 97 can be prevented. Furthermore, when the latches 97 are moved further forward after the second flat-plates 93*a* have contacted the anti-overstress stops 92*a*, the anti-overstress stops 92*a* can move together with the latches 97 in the forward direction indicated by the arrow B in FIG. 9. Moreover, since the projections 95 that position the card C are connected to the anti-overstress stops 92*a* via the first flat-plate 92 and rearward-extensions 92*b*, the projections 95 can also move in the same direction as the anti-overstress stops 92*a* at the same time that the anti-overstress stops 92*a* can move together with the latches 97. Thus, the card C can easily be released. Furthermore, since the curved shapes of the projections 95 that position the card C can contact the edges of the holes C3 in the card C, the card C can easily be released.

In the present embodiment, the latch 91 is carried on and fastened to the motherboard PCB without being assembled with the card edge connector 50, and the latches 97 extend toward and engage with the opposite end portion that is opposite the contact end portion of the card C that is received in the card edge connector 50. Accordingly, there is no need for spaces to allow flexing of the latches 97 on both outer sides of the card C. Also, there is no need for members for the latching of the card on both outer sides of the card C. Consequently, in cases where cards C are mounted side by side on the motherboard PCB, these cards C can be mounted side by side at a high density without increasing the overall size of the connector.

Since the latch 91 comprises a vacuum pick-up surface 98 which extends in the opposite direction from the latches 97 in the center (with respect to the lengthwise direction) of the first flat-plate 92, the latch 91 can be automatically mounted on the motherboard PCB by an automated mounting apparatus.

Also, since projections 95 which position the card C by being inserted into holes C3 formed in the vicinity of the corners of the opposite end portion of the card C are disposed in the vicinity of the latches 97, the card C can easily be positioned.

Embodiments of the present invention were described above. However, the present invention is not limited to these embodiments; various alterations or modifications may be made.

For example, the latch 1 is integrally formed by stamping and forming a metal plate; however, it would also be possible to use a metal latch that is constructed from two or more members.

Furthermore, it would also be possible to install anti-overstress stops (that prevent the excessive displacement of the respective latches 87 in the direction that releases the engagement with the opposite end portion of the card C) on the latch 81 shown in FIGS. 6A to 6D.

Furthermore, operating portions that extend from the latches 7 or 97 may also be installed on the latch 1 shown in FIGS. 1 through 5 or latch 91 shown in FIGS. 7A to 7F through 9.

What is claimed is:

1. A card edge latch for use together with a card edge connector to mount a card on a motherboard, the card edge latch comprising:

board fasteners which are fastened to said motherboard; and latches which, with a contact end portion of said card being received in said card edge connector, latch an opposite end portion of said card in a state in which said card is substantially parallel to said motherboard;

wherein said latch is carried on and fastened to the motherboard opposite the card edge connector without being assembled with said card edge connector, and said latches extend toward and engage with said opposite end portion of said card.

2. The card edge latch according to claim 1, wherein said card edge latch comprises a vacuum pick-up surface in the center, which extends in the opposite direction from said latches.

3. The card edge latch according to claim 1, further comprising projections disposed in the vicinity of said latches to position said card by being inserted into holes formed in the vicinity of the corners of said opposite end portion of said card.

4. The card edge latch according to claim 1, wherein said latches are formed by molding of a resin.

5. The card edge latch according to claim 1, wherein operating portions are disposed on said latches and said operating portions are configured to move said latches in the direction that releases the engagement with said opposite end portion of said card.

6. The card edge latch according to claim 1, further comprising anti-overstress stops that prevent excessive displacement of said latches in the direction that releases the engagement with said opposite end portion of said card.

7. The card edge latch according to claim 6, wherein said anti-overstress stops have a construction that allows movement together with said latches, the projections that position said card are connected to said anti-overstress stops, and when said anti-overstress stops move together with said latches, said projections that position said card move at the same time.

8. The card edge latch according to claim 3, wherein said projections that position said card are formed into a curved shape by forming.

9. A card edge latch for use together with a card edge connector to mount a card on a motherboard, the card edge latch comprising:

board fasteners which are fastened to said motherboard; and latches configured to pivot away from said card to receive and to release an opposite end portion of said card when said card is rotated about a contact end portion thereof being received in said card edge connector, and to latch said opposite end of said card when said card is substantially parallel to said motherboard;

wherein said latch is carried on and fastened to the motherboard opposite the card edge connector without being assembled with said card edge connector, and said latches extend toward and engage with said opposite end portion of said card.

10. The card edge latch according to claim 9, wherein said card edge latch comprises a vacuum pick-up surface in the center, which extends in the opposite direction from said latches.

11. The card edge latch according to claim 9, further comprising projections disposed in the vicinity of said latches to position said card by being inserted into holes formed in the vicinity of the corners of said opposite end portion of said card.

12. The card edge latch according to claim 9, wherein said latches are formed by molding of a resin.

13. The card edge latch according to claim 9, wherein operating portions are disposed on said latches and said operating portions are configured to move said latches in the direction that releases the engagement with said opposite end portion of said card.

14. The card edge latch according to claim 9, further comprising anti-overstress stops that prevent excessive displacement of said latches in the direction that releases the engagement with said opposite end portion of said card.

15. The card edge latch according to claim 14, wherein said anti-overstress stops have a construction that allows movement together with said latches, the projections that position said card are connected to said anti-overstress stops, and when said anti-overstress stops move together with said latches, said projections that position said card move at the same time.

16. The card edge latch according to claim 11, wherein said projections that position said card are formed into a curved shape by forming.

* * * * *